US009328304B2

(12) United States Patent
Baran, Jr. et al.

(10) Patent No.: US 9,328,304 B2
(45) Date of Patent: May 3, 2016

(54) COMPOSITE PARTICLES AND METHOD OF FORMING

(71) Applicant: 3M INNOVATIVE PROPERTIES COMPANY, St. Paul, MN (US)

(72) Inventors: Jimmie R. Baran, Jr., Prescott, WI (US); Haeen Sykora, New Richmond, WI (US); Madeline P. Shinbach, St. Paul, MN (US); Roxanne A. Boehmer, Inver Grove Heights, MN (US); Daniel W. Wuerch, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 167 days.

(21) Appl. No.: 14/254,213

(22) Filed: Apr. 16, 2014

(65) Prior Publication Data

US 2014/0228262 A1 Aug. 14, 2014

Related U.S. Application Data

(63) Continuation of application No. 13/141,340, filed as application No. PCT/US2009/066911 on Dec. 7, 2009, now Pat. No. 8,741,819.

(60) Provisional application No. 61/141,311, filed on Dec. 30, 2008.

(51) Int. Cl.

| | |
|---|---|
| ***C10M 103/06*** | (2006.01) |
| ***C10M 139/04*** | (2006.01) |
| ***C10M 159/12*** | (2006.01) |
| ***C10M 135/36*** | (2006.01) |
| ***C10M 141/12*** | (2006.01) |
| ***C10M 171/06*** | (2006.01) |

(52) U.S. Cl.

CPC ..... *C10M 103/06* (2013.01); *C10M 135/36* (2013.01); *C10M 139/04* (2013.01); *C10M 141/12* (2013.01); *C10M 159/12* (2013.01); *C10M 171/06* (2013.01); *C10M 2201/06* (2013.01); *C10M 2201/062* (2013.01); *C10M 2201/105* (2013.01); *C10M 2227/04* (2013.01); *C10N 2210/02* (2013.01); *C10N 2210/03* (2013.01); *C10N 2210/04* (2013.01); *C10N 2210/08* (2013.01); *C10N 2220/082* (2013.01); *C10N 2230/06* (2013.01); *C10N 2250/04* (2013.01); *C10N 2250/10* (2013.01); *C10N 2250/121* (2013.01); *Y10T 428/2982* (2015.01); *Y10T 428/2995* (2015.01)

(58) Field of Classification Search

CPC ..... C10M 135/36; C10M 2250/10; C10M 103/06; C10M 139/14; C10M 141/12; C10M 159/12; C10M 171/06; C10M 2201/062; C10M 2201/105; C10M 2227/04; C10N 2210/02; C10N 2210/03; C10N 2210/04; C10N 2210/08; C10N 2220/082; C10N 2230/06; C10N 2250/04; C10N 2250/10; C10N 2250/121; Y10T 428/2982; Y10T 428/2995

USPC ..... 508/100, 103, 108, 165, 201

See application file for complete search history.

(56) References Cited

U.S. PATENT DOCUMENTS

| | | | | |
|---|---|---|---|---|
| 3,565,985 | A | 2/1971 | Schrenk | |
| 4,767,726 | A | 8/1988 | Marshall | |
| 4,863,721 | A | 9/1989 | Beck | |
| 5,037,579 | A | 8/1991 | Matchett | |
| 5,145,762 | A | 9/1992 | Grushkin | |
| 5,427,847 | A | 6/1995 | Zawada | |
| 5,589,122 | A | 12/1996 | Leonard | |
| 5,599,602 | A | 2/1997 | Leonard | |
| 5,660,922 | A | 8/1997 | Herridge | |
| 5,672,240 | A | 9/1997 | Stoner | |
| 5,883,029 | A | 3/1999 | Castle | |
| 6,116,718 | A * | 9/2000 | Peeters | B41J 2/01 347/21 |
| 6,329,058 | B1 | 12/2001 | Arney | |
| 6,416,864 | B1 * | 7/2002 | Hayashi | G03G 9/083 428/403 |
| 6,432,526 | B1 | 8/2002 | Arney | |
| 6,586,483 | B2 | 7/2003 | Kolb | |
| 8,741,819 | B2 * | 6/2014 | Baran, Jr. | C10M 139/04 508/100 |
| 2004/0242729 | A1 | 12/2004 | Baran | |
| 2004/0242730 | A1 | 12/2004 | Baran | |
| 2008/0152913 | A1 | 6/2008 | Shinbach | |
| 2008/0153963 | A1 | 6/2008 | Baran | |
| 2008/0286362 | A1 | 11/2008 | Baran | |
| 2008/0318820 | A1 | 12/2008 | Suda et al. | |
| 2011/0257054 | A1 | 10/2011 | Baran | |

FOREIGN PATENT DOCUMENTS

| | | |
|---|---|---|
| CN | 101089163 A | 12/2007 |
| JP | 2005-097514 | 4/2005 |
| WO | WO 03/044099 | 3/2003 |
| WO | WO 2007/031775 | 3/2007 |

OTHER PUBLICATIONS

Wikipedia "Grease (lubricant)" http://en.wikipedia.org/wiki/Grease_(lubricant) (Sep. 12, 2008).

U.S. Army Corps of Engineers Publication No. EM 1110-2-1424 "Engineering and Design—Lubricants and Hydraulic Fluids. Chapter 5—Grease", pp. 5-1 to 5-11 (Feb. 28, 1999).

* cited by examiner

*Primary Examiner* — James Goloboy

(74) *Attorney, Agent, or Firm* — Kent S. Kokko

(57) ABSTRACT

Composite particles and a method of forming composite particles are described. The composite particles comprise at least one inorganic nanoparticle covalently bound to at least one inorganic microparticle with a linking compound. Lubricant compositions and sprayable dispersion compositions comprising composite particles are also described.

20 Claims, No Drawings

COMPOSITE PARTICLES AND METHOD OF FORMING

CROSS REFERENCE TO RELATED APPLICATIONS

This application is a continuation of U.S. application Ser. No. 13/141,340, filed Jun. 22, 2011, which is a national stage filing under 35 U.S.C. 371 of PCT/US2009/066911, filed Dec. 7, 2009, which claims priority to Provisional Application No. 61/141,311, filed Dec. 30, 2008, the disclosure of which is incorporated by reference in its entirety herein.

FIELD

The present disclosure relates to composite particles and a method of forming composite particles.

BACKGROUND

Inorganic particles having dimensions on the micrometer and nanometer scales have been used in many applications. Inorganic particle emulsions and dispersions containing nanoparticles have been described in U.S. Patent Application Publications 2004/0242729 and 2004/0242730 (Baran Jr., et al.).

Surface modification of individual particles can provide for stability and functionalization of such particles. Effective surface modification of these particles can result in individual, unassociated particles for particle compositions which are essentially free of particle agglomeration or aggregation that would potentially interfere with the desired properties of the composition.

Surfaces of particles can be modified by chemical, electrodeposition, and other known techniques. Some applications have been described including uses as catalysts in chemical reactions, and as additives in coating compositions.

SUMMARY

The present disclosure describes composite particles and a method of forming composite particles. More specifically, composite particles are formed by covalently bonding an inorganic microparticle to an inorganic nanoparticle through a metal atom M of a linking compound. Composite particles described herein are useful as lubricant compositions and sprayable dispersion compositions.

In one aspect, a composite particle is described. The composite particle comprises at least one inorganic microparticle, at least one inorganic nanoparticle and at least a linking compound comprising a metal atom M selected from the group consisting of Si and Ti. At least one linking compound is covalently bound to at least one inorganic nanoparticle through M and covalently bound to at least one inorganic microparticle through M.

In one aspect, a method of forming a composite particle is described. The method includes providing a mixture comprising at least one inorganic nanoparticle, a solvent, and at least one linking compound of the formula $M(Z)_n(R)_m$. Each metal atom M is independently selected from the group consisting of Si and Ti. Each Z is independently selected from the group consisting of —OR' and —X. R' is $C_1$-$C_6$ selected from linear, branched, and cyclic groups or combinations thereof or which may be substituted. X is a halide. Each R is $C_1$-$C_{18}$ selected from linear, branched, and cyclic groups, or combinations thereof or which may be substituted. In the formula $M(Z)_n(R)_m$, n is 2 or 3 and m is 1 or 2. The method includes agitating the mixture so that at least one linking compound is covalently bound to at least one inorganic nanoparticle through metal atom M to provide at least one inorganic nanoparticle precursor. The method also includes adding at least one inorganic microparticle to the mixture so that at least one inorganic nanoparticle precursor is covalently bound to at least one inorganic microparticle through metal atom M.

DETAILED DESCRIPTION

Although the present disclosure is herein described in terms of specific embodiments, it will be readily apparent to those skilled in the art that various modifications, rearrangements, and substitutions can be made without departing from the spirit of the invention. The scope of the present invention is thus only limited by the claims appended herein.

The term "composite particle" refers to at least one inorganic nanoparticle covalently bound to at least one inorganic microparticle by a linking compound.

The term "nanoparticle" as used herein (unless an individual context specifically implies otherwise) will generally refer to particles, groups of particles, particulate molecules (i.e., small individual groups or loosely associated groups of molecules) and groups of particulate molecules that while potentially varied in specific geometric shape have an effective, or average, diameter that can be measured on a nanoscale (i.e., less than about 100 nanometers).

The term "microparticle" as used herein (unless an individual context specifically implies otherwise) will generally refer to particles, groups of particles, particulate molecules (i.e., small individual groups or loosely associated groups of molecules) and groups of particulate molecules that while potentially varied in specific geometric shape have an effective, or average, diameter that can be measured on a microscale (i.e., greater than 0.1 micrometer to about 500 micrometers.

The terms "particle diameter" and "particle size" are defined as the maximum cross-sectional dimension of a particle. If the particle is present in the form of an aggregate, the terms, "particle diameter" and "particle size" refer to the maximum cross-sectional dimension of the aggregate.

The term "dispersion" refers to a composition that contains a plurality of composite particles suspended or distributed in a propellant without substantial agitation or such that the plurality of composite particles can be dispersed again with minimal energy input. As used herein, the term "separate" or "settle" refers to forming a concentration gradient of composite particles within a solution due to gravitational forces.

The recitation of numerical ranges by endpoints includes all numbers subsumed within that range (e.g., 1 to 5 includes 1, 1.5, 2, 2.75, 3, 3.8, 4, and 5).

As included in this specification and the appended claims, the singular forms "a", "an", and "the" include plural referents unless the content clearly dictates otherwise. Thus, for example, reference to a composition containing "a compound" includes a mixture of two or more compounds. As used in this specification and appended claims, the term "or" is generally employed in its sense including "and/or" unless the content clearly dictates otherwise.

Unless otherwise indicated, all numbers expressing quantities or ingredients, measurement of properties and so forth used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings of the present disclosure. At the very least, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains errors necessarily resulting from the standard deviations found in their respective testing measurements.

The present disclosure describes a composite particle comprising at least one inorganic nanoparticle (np) covalently bound to at least one inorganic microparticle (mp) through metal atom M of the linking compound illustrated by Formula I:

$$M(Z)_n(R)_m \quad \text{(I).}$$

Formula I has a metal atom M independently selected from the group consisting of Si and Ti. Metal atom M has at least two reactive groups Z, and at least one surface modifying group R. Subscript n is 2 or 3, and subscript m is 1 or 2. At least one group Z of the linking compound reacts with the surface of at least one inorganic nanoparticle forming a covalent bond to metal atom M, and a second group Z of the same linking compound reacts with the surface of the at least one inorganic microparticle forming a covalent bond to metal atom M.

In the composite particle described herein, the linking compound is covalently bound through M to the inorganic nanoparticle and the inorganic microparticle, such that n is 0 or 1, and m is 1 or 2. At least two groups of Z, attached to the linking compound, react with each of the inorganic nanoparticle and the inorganic microparticle, and covalently bond through metal atom M. In general, the composite particle formed herein can be illustrated by Formula (II):

$$\text{(mp-)M(R)(-np)} \quad \text{(II).}$$

In Formula I, at least one inorganic microparticle (mp) covalently bonds to metal atom M of a linking compound, and at least one inorganic nanoparticle (np) covalently bonds to the same metal atom M of the linking compound. The R group attached to metal atom M of the linking compound can modify the surface of the resulting composite particle. Some examples of surface modification of the composite particles described herein can result in properties such as dispersability or lubrication. Composite particles, in some examples, can be dispersed in solvents, propellants, resins, and other mediums. Composite particles, in some examples, can provide lubricious properties for applications in lubricants, greases, and other related compositions.

The surfaces of each of the inorganic microparticles and the inorganic nanoparticles can have functional groups, for example, which result from oxidation at the particle surface (e.g., hydroxyl groups), and which are available for reaction with group Z of the linking compound. The composite particle described herein comprises inorganic microparticles and inorganic nanoparticles each without surface modification prior to chemical reaction with the linking compound. The term "without surface modification" generally refers to inorganic nanoparticles or inorganic microparticles each having oxidized surfaces without subsequent chemical modification or the introduction of chemical functional groups prior to introduction of the linking compound. The composite particle as formed provides an efficient means for covalently bonding inorganic nanoparticles to inorganic microparticles without additional particle isolation and reaction steps.

A method for forming composite particles is also described. The formation of composite particles by this method reduces the number of processing steps resulting in increased yields of composite particles. A mixture comprising at least one inorganic nanoparticle, a solvent and a linking compound having the formula, $M(Z)_n(R)_m$, are agitated to form at least one inorganic nanoparticle precursor. The inorganic nanoparticle precursor is formed from covalent bonding of at least one inorganic nanoparticle through M of the linking compound. At least one inorganic microparticle is added to the mixture so that at least one inorganic nanoparticle precursor is covalently bound to at least one inorganic microparticle through M of the linking compound to form the composite particle.

A lubricant composition comprising a plurality of composite particles is also described. Such lubricant compositions have lubricious properties as measured by coefficient of friction testing. The composite particles comprising spherical inorganic microparticles have similar coefficient of friction test results to those of known lamellar materials (e.g., boron nitride).

Sprayable dispersion compositions comprising a propellant and a plurality of composite particles are also described. The plurality of composite particles is dispersed in the propellant to provide a sprayable dispersion composition. The sprayable dispersion compositions can be applied to substrates without the additional step of solvent removal.

Inorganic microparticles (mp) suitable for forming composite particles typically have an average particle size as described above. Some inorganic microparticles can have a distribution of microparticle sizes, wherein a majority of the microparticles generally fall within the range of greater than 0.1 micrometer to about 500 micrometers. Some of the inorganic microparticles can have average particle sizes outside of the microparticle distribution.

Suitable inorganic microparticles can be distinguished from inorganic nanoparticles useful for forming composite particles by their relative size or median particle size or diameter, shape, and/or functionalization within or on the microparticle surface, wherein the inorganic microparticles are typically larger than the inorganic nanoparticles. Inorganic microparticles can have geometries which include spherical, ellipsoidal, cubic, or other known geometries. In some embodiments, composite particles useful in lubricant compositions and sprayable dispersion compositions comprise inorganic microspheres having a spheroidal shape. In some embodiments, the inorganic microparticles are the same (e.g., in terms of size, shape, composition, microstructure, surface characteristics, etc.); while in other embodiments they are different. In some embodiments, the inorganic microparticles selected can have a modal (e.g., bi-modal or tri-modal) particle size distribution. In some embodiments, more than one type of inorganic microparticle can be useful for the formation of composite particles. A combination of mixed inorganic microparticles can be used. It will be understood that inorganic microparticles can be used alone, or in combination with one or more other inorganic microparticles including mixtures and/or combinations of inorganic microparticles covalently bonded to inorganic nanoparticles for forming composite particles.

Some suitable examples of inorganic microparticles include abrasives, metals, metal oxides and ceramic microparticles (including beads, bubbles, microspheres and aerogels). Examples metal oxide microparticles can include zirconia, titania, silica, ceria, alumina, iron oxide, vanadia, zinc oxide, antimony oxide, tin oxide, nickel oxide, calcium, and zinc phosphates, and combinations thereof. Some other suitable inorganic microparticles include, for example, composite structures such as those containing alumina/silica, iron oxide/titania, titania/zinc oxide, zirconia/silica, and combinations thereof. Metals such as gold, silver, or other precious metals can also be utilized as solid inorganic microparticles. Other examples of inorganic microparticles include fillers (e.g., titanium dioxide, calcium carbonate, and dicalcium phosphate, nepheline (available under the tradename designation, "MINEX" (Unimin Corporation, New Canaan, Conn.), feldspar and wollastonite), excipients, exfolients, cosmetic ingredients, silicates (e.g., talc, clay, and sericite), aluminates and combinations thereof.

Ceramic microparticles can be made using techniques known in the art and/or are commercially available. Ceramic bubbles and ceramic microspheres are described, for example, in U.S. Pat. No. 4,767,726 (Marshall), and U.S. Pat. No. 5,883,029 (Castle). Examples of commercially available glass bubbles include those marketed by 3M Company, St. Paul, Minn., under the designation "3M SCOTCHLITE GLASS BUBBLES" (e.g., grades K1, K15, S15, S22, K20, K25, S32, K37, S38, K46, S60/10000, S60H5, A16/500, A20/1000, A20/1000, A20/1000, A20/1000, HSO/10000 EPX, and H50/10000 (acid washed)); glass bubbles marketed by Potter Industries, Valley Forge, Pa., under the trade designation "SPHERICEL" (e.g., grades 110P8 and 60P18), "LUXSIL", and "Q-CEL" (e.g., grades 30, 6014, 6019, 6028, 6036, 6042, 6048, 5019, 5023, and 5028); hollow glass microspheres marketed under the trade designation "DICAPERL" by Grefco Minerals, Bala Cynwyd, Pa., (e.g., grades HP-820, HP-720, HP-520, HP-220, HP-120, HP-900, HP-920, CS-10-400, CS-10-200, CS-10-125, CSM-10-300, and CSM-10-150); and hollow glass particles marketed by Silbrico Corp., Hodgkins, Ill., under the trade designation "SIL-CELL" (e.g., grades SIL 35/34, SIL-32, SIL-42, and SIL-43). Commercially available ceramic microspheres include ceramic hollow microspheres marketed by SphereOne, Inc., Silver Plume, Colo., under the trade designation, "EXTENDOSPHERES" (e.g., grades SG, CG, TG, SF-10, SF-12, SF-14, SLG, SL-90, SL-150, and XOL-200); and ceramic microspheres marketed by 3M Company under the trade designation "3M CERAMIC MICROSPHERES" (e.g., grades G-200, G-400, G-600, G-800, G-850, W-210, W-410, and W-610). In some embodiments, the inorganic microparticles useful for forming composite particles are at least one of ceramic microspheres, ceramic beads, ceramic bubbles, or silicates. In some embodiments, inorganic microparticles useful for forming composite particles are at least one of fillers including, for example, titanium dioxide, calcium carbonate, and dicalcium phosphate.

Nanoparticles described in the present disclosure are inorganic nanoparticles (np). Inorganic nanoparticles are present in an amount sufficient to modify the surface of the inorganic microparticle through covalently bonding to the surface of the inorganic microparticle through a linking compound having a metal atom M. In a method for forming composite particles, at least one inorganic nanoparticle is modified with a linking compound through metal atom M to form at least one inorganic nanoparticle precursor. The inorganic nanoparticle precursor covalently bonds with at least one inorganic microparticle through metal atom M of the inorganic nanoparticle precursor to form a composite particle. In some embodiments, more than one inorganic nanoparticle precursor can covalently to the same inorganic microparticle for forming a composite particle Inorganic nanoparticles can have geometries which include spherical, ellipsoidal, cubic, or other known geometries known to those of skilled in the art. Some nonspherical geometries can be envisioned for bonding with inorganic microparticles to form composite particles. In some embodiments, it is desirable for the inorganic nanoparticle to be substantially spherical in shape. In some embodiments, spherical inorganic nanoparticles can covalently bond to inorganic microparticle to form a lubricant composition. In some applications, elongated shapes (e.g., ellipsoidal) shapes are preferred for bonding to inorganic microparticles.

Suitable inorganic nanoparticles include metal oxide nanoparticles such as zirconia, titania, silica, ceria, alumina, iron oxide, vanadia, zinc oxide, antimony oxide, tin oxide, nickel oxide, calcium and zinc phosphates, and combinations thereof. Other suitable inorganic nanoparticles include structures including alumina/silica, iron oxide/titania, titania/zinc oxide, zirconia/silica, and combinations thereof. Metals such as gold, silver, or other precious metals can also be utilized. In one embodiment, the inorganic nanoparticles are one of at least silica, alumina, zirconia, titania, or combinations thereof.

Some useful inorganic nanoparticles can be in the form of a colloidal dispersion. Some of these dispersions are commercially available as silica starting materials, for example, nano-sized colloidal silicas available under the product designations "NALCO 1040," "NALCO 1050," "NALCO 1060," "NALCO 2326," "NALCO 2327," and "NALCO 2329" colloidal silica from Nalco Chemical Company of Naperville, Ill. Other metal oxide colloidal dispersions can include colloidal zirconium oxide, suitable examples of which are described, for example, in U.S. Pat. No. 5,037,579 (Matchett), and colloidal titanium oxide, examples of which are described, for example, in U.S. Pat. Nos. 6,329,058 and 6,432,526 (Arney et al.). Such inorganic nanoparticles are suitable for covalently bonding to inorganic microparticles.

Inorganic nanoparticles or mixtures and combinations of inorganic nanoparticles for covalently bonding to inorganic microparticles through metal atom M of the linking compound can be used. Selected inorganic nanoparticles will generally have an average particle size of less than 100 nanometers. In some embodiments, inorganic nanoparticles can be utilized having a smaller average particle size of, for example, less than or equal to 50 nanometers, less than or equal to 40 nanometers, less than or equal to 30 nanometers, less than or equal to 20 nanometers, less than or equal to 15 nanometers, less than or equal to 10 nanometers or less than or equal to 5 nanometers. In some embodiments, the average particle size of the inorganic nanoparticle can be in a range from about 2 nanometers to about 20 nanometers, in a range from about 3 nanometers to about 15 nanometers, or in a range from about 4 nanometers to about 10 nanometers.

Linking compounds useful for forming composite particles of the present disclosure are described. The linking compound of Formula (I) covalently bonds an inorganic nanoparticle and an inorganic microparticle described herein to one another through metal atom M. At least one inorganic microparticle is covalently bonded to at least one inorganic nanoparticle with a linking compound through the metal atom M. In some embodiments, the linking compound covalently bonds to inorganic microparticles and the inorganic nanoparticles through metal atom M via a condensation reaction.

Formula (I) of the linking compound is schematically represented by Formula (I):

$$M(Z)_n(R)_m \quad \text{(I).}$$

Metal atom M of Formula (I) is represented by an atom independently selected from the group consisting of Si and Ti. Group Z is independently selected from the group consisting of —OR' and —X. R' of the group —OR' is $C_1$-$C_6$ selected from linear groups, branched groups, cyclic groups, or combinations thereof or which may be substituted. Each of group X is a halide. Each surface modifying group, R, is $C_1$-$C_{18}$ selected from linear groups, branched groups, cyclic groups, or combinations thereof. Subscript, n, is 2 or 3, and subscript, m, is 1 or 2. The term "substituted" means, for a chemical species, group or moiety, substituted by conventional substituents which do not interfere with the desired product or process, e.g., substituents can be alkyl, alkoxy, aryl, phenyl, halo (F, Cl, Br, I), cyano, nitro, etc.

Group Z of Formula (I) is a functional group that is capable of chemically reacting and attaching through M to the surface of each of the inorganic nanoparticle and the inorganic microparticle. For forming composite particles, inorganic nanoparticles and/or inorganic microparticles can be processed in a solvent, where group R of the linking compound can function as a compatibilizing group with whatever solvent is used to process the covalent bonding of inorganic nanoparticles with inorganic microparticles. Upon formation of the composite particles, group R can be a surface modifying group that is capable of preventing irreversible agglomeration of the composite particles. In some embodiments, R can function as a compatibilizing group during formation of the composite particle, and as a surface modify group of the resulting composite particle.

The linking compound of Formula (I) can be described generally as a molecule having at least two functional reactive groups, represented as group Z, and at least one surface modifying group R. The group R of the linking compound can be generally used to modify the surface of the formed composites particles. In general, group R does not chemically react with the surfaces of the inorganic microparticles or the inorganic nanoparticles. The group Z can covalently bond to the surface of each of the inorganic microparticle and the inorganic nanoparticle through a metal atom M.

In some embodiments, group R of the linking compound is an alkyl group ($C_1$-$C_{18}$) useful for modifying the surface of the composite particles. In some embodiments, the group R of the composite particles provides a hydrophobic surface. The selected group R can surface modify the composite particles so as to minimize aggregation or agglomeration of the composite particles. In some embodiments, the linking group having group R can be an isooctyl group, a methyl group, an ethyl group, an isobutyl group, or combinations thereof.

In some embodiments, two or more linking compounds of Formula (II) can be selected to covalently bond the inorganic nanoparticles to the inorganic microparticles through metal atom M for forming composite particles. In some embodiments, group R of each of the linking compounds can be different (e.g., group R is methyl for a first linking compound and group R is isooctyl for a second linking compound). In some embodiments, a first linking compound is isooctyl trimethoxysilane (R is $C_8$) and a second linking compound is methyl trimethoxysilane (R is $C_1$).

In some embodiments, linking compounds of Formula (I) can include silanes. Examples of silanes include organosilanes such as alkylchlorosilanes; alkoxysilanes (e.g., methyltrimethoxysilane, methyltriethoxysilane, ethyltrimethoxysilane, ethyltriethoxysilane, n-propyltrimethoxysilane, n-propyltriethoxysilane, i-propyltrimethoxysilane, i-propyltriethoxysilane, butyltrimethoxysilane, butyltriethoxysilane, hexyltrimethoxysilane, octyltrimethoxysilane, 3-mercaptopropyltrimethoxysilane, n-octyltriethoxysilane, isooctyltrimethoxysilane, phenyltriethoxysilane, polytriethoxysilane, vinyltrimethoxysilane, vinylmethyldiacetoxysilane, vinylmethyldiethoxysilane, vinyltriacetoxysilane, vinyltriethoxysilane, vinyltriisopropoxysilane, vinyltrimethoxysilane, vinyltriphenoxysilane, vinyltri(t-butoxy)silane, vinyltris(isobutoxy)silane, vinyltris(isopropenoxy)silane, and vinyltris(2-methoxyethoxy)silane; trialkoxyarylsilanes; isooctyltrimethoxysilane; N-(3-triethoxysilylpropyl)methoxyethoxyethoxy ethyl carbamate; N-(3-triethoxysilylpropyl)methoxyethoxyethoxyethyl carbamate; silane functional (meth)acrylates (e.g., 3-(methacryloyloxy)propyltrimethoxysilane, 3-acryloyloxypropyltrimethoxysilane, 3-(methacryloyloxy)propyltriethoxysilane, 3-(methacryloyloxy)propylmethyldimethoxysilane, 3-(acryloyloxypropyl)methyldimethoxysilane, 3-(methacryloyloxy)methyltriethoxysilane, 3-(methacryloyloxy)methyltrimethoxysilane, 3-(methacryloyloxy)propenyltrimethoxysilane, and 3-(methacryloyloxy)propyltrimethoxysilane)); arylsilanes (e.g., substituted and unsubstituted arylsilanes); alkylsilanes (e.g., substituted and unsubstituted alkyl silanes (e.g., methoxy and hydroxy substituted alkyl silanes)), and combinations thereof.

In some embodiments, the linking compound of Formula (I) comprises alkoxysilanes, halogenated silanes, alkoxytitaniums, or combinations thereof. In one embodiment, the alkoxysilane is an alkylalkoxysilane, such that group R is an alkyl group.

In one embodiment, composite particles can comprise a plurality of inorganic nanoparticles covalently bound to at least one inorganic microparticle. The inorganic nanoparticles are selected to be compatible with the inorganic microparticles. Generally, the selection of the inorganic nanoparticles will be governed at least in part by the specific performance requirements for the resulting composite particles and their intended application.

Composite particles as described herein are formed resulting in composite particles that are essentially free from a degree of particle association, agglomeration, or aggregation. As used herein, particle "association" is defined as a reversible chemical combination due to any of the weaker classes of chemical bonding forces. Examples of particle association include hydrogen bonding, electrostatic attraction, London forces, van der Waals forces, and hydrophobic interactions. As used herein, the term "agglomeration" is defined as a combination of molecules or colloidal particles into clusters. Agglomeration may occur due to the neutralization of the electric charges, and is typically reversible. As used herein, the term "aggregation" is defined as the tendency of large molecules or colloidal particles to combine in clusters or clumps and precipitate or separate from the dissolved state. Aggregated composite particles are firmly associated with one another, and require high shear to be broken. Agglomerated and associated composite particles can generally be easily separated.

Surface modifying groups (i.e., group R) of Formula (II) are selected to modify the surface of the composite particles described herein. The surfaces of the composite particles are selected in such a way that dispersions or solid formulations formed with them are free from a degree of particle agglomeration or aggregation that would interfere with the desired properties of the dispersion or application. The surfaces of such composite particles are generally selected to be either hydrophobic or hydrophilic such that, depending on the character of the resulting composite particle and other materials for mixing with the composite particles, the resulting dispersion or solid composition exhibits substantially free flowing (i.e., the ability of a material to maintain a stable, steady and uniform/consistently flow, as individual particles) properties. In some embodiments, the surfaces of the composite particles are hydrophobic.

Suitable R groups of the linking compound of Formula (II) constituting the surface modification of the composite particles can be selected based upon the nature of the inorganic microparticles or inorganic nanoparticles used, and the properties desired of the resulting dispersion, powder, or application. When using a solvent which is hydrophobic, for example, one skilled in the art can select from among various hydrophobic surface groups to achieve composite particles that are compatible with the hydrophobic solvent; when the processing solvent is hydrophilic, one skilled in the art can select from various hydrophilic surface groups; and, when the solvent is a hydrofluorocarbon or fluorocarbon, one skilled in the art can select from among various compatible surface groups; and so forth. The nature of the composite particles and the solvent in addition to the desired final properties can also affect the selection of the linking compound having a group R. In some embodiments, the composite particles can include two different R groups that combine to provide composite particles having a desired set of characteristics. The R groups will generally be selected to provide a statistically averaged, randomly surface modified composite particle.

Solvents useful in the method for forming the composite particle can include a solvent or a mixture of solvents. Solvents selected are generally compatible with group R (i.e., linking compound) and the surfaces of the formed composite particles. In the method described herein, polar solvents are used to disperse the inorganic nanoparticles, inorganic nanoparticle precursors, inorganic microparticles, and the formed composite particles. Similarly, polar solvents described are selected to be compatible with the linking compound. In some embodiments, the solvent can be selected from alcohols, ketones, glycols, amides, sulfoxides and cyclic ethers. In some embodiments, a mixture of alcohols such as ethanol and methanol can be used in the method of forming composite particles.

In one embodiment, the weight ratio of inorganic nanoparticles to inorganic microparticles of the composite particles is at least 1:100,000. In some embodiments, the weight ratio of inorganic nanoparticles to inorganic microparticles is in a range from about 1:100,000 to about 1:20, in a range from about 1:10,000 to about 1:500, in a range from about 1:5,000 to about 1:1,000.

Composite particles as described herein are useful as lubricant compositions. Many types of lubricant compositions (e.g., lubricants) have been described in the art. These lubricants are valued in many applications for self-lubricating and dry lubricating properties at low and high temperature applications. Some examples of commercially available lubricants include graphite (hexagonal (alpha form) and rhomdohedral (beta form), boron nitride (hexagonal form), molybdenum disulfide and others. Hexagonal boron nitride as a high temperature lubricant has the same molecular structure as graphite.

Lubricants can be delivered to surfaces in many forms including, for example, as a powder, grease, an aerosol, or other compositions. Generally, lubricants function so as to remain in contact with moving surfaces without leaking out under gravity or centrifugal action, or to be squeezed out under pressure. Practically, lubricants can retain their properties under shear at all temperatures that it is subjected to during use.

Some useful lubricants including greases have properties ranging from semi-fluid to solid. Greases generally comprise a fluid lubricant, a thickener and additives. The fluid lubricant can perform actual lubrication such as petroleum (mineral) oil, synthetic oil, or vegetable oil. The thickener provides grease its characteristic consistency and can be referred to as a three dimensional network to hold the oil in place. Additives enhance performance and protect the grease and lubricated surfaces. Solid lubricants for greases are suspended, such as graphite and molybdenum disulfide for high temperature applications in excess of 315° C. or in extreme high-pressure applications.

Composite particles useful in lubricant compositions described herein comprise a plurality of composite particles having inorganic microparticles with a spheroidal shape. Not to be bound by theory, the spherical shape of the inorganic microparticle having inorganic nanoparticles covalently bound to its surface can provide a generally spherical composite particle. The spherical structure of the composite particle can provide similar coefficient of friction test results to those of known lamellar materials, e.g., boron nitride and graphite. In some embodiments, a lubricant composition as a powder comprising a plurality of composite particles can be formed.

Lubricant compositions comprising composite particles can further comprise a fluid component, a thickener and additives such as greases. In some embodiments, grease can be formed having composite particles. In another embodiment, the grease further comprises a film forming material.

The lubricant compositions comprising composite particles have lubricious properties. Coefficient of friction testing results of the lubricant compositions having composite particles have similar coefficient of friction values as compared to known lubricants (e.g., boron nitride). In some embodiments, composite particles have a lower coefficient of friction at 200° C. than at 20° C. in comparison to boron nitride.

In some embodiments, composite particles can provide lubricants in the form of sprayable dispersion compositions. The composite particles are dispersed in a propellant, and remain stable over a useful time period without substantial agitation or which are easily redispersed with minimal energy input. The sprayable dispersion compositions described herein comprises dispersed composite particles and a propellant as a continuous phase which are rendered stable with the incorporation of an effective amount of composite particles into the continuous phase. An effective amount of composite particles is an amount that has minimized the aggregation of the dispersed composite particles and forms stable dispersions that remain dispersed over a useful time period without substantial agitation of the dispersion or which are easily redispersed with minimal energy input. Suitable propellants of the sprayable dispersion compositions include, for example, a chlorofluorocarbon (CFC), such as trichlorofluoromethane, dichlorodifluoromethane, and 1,2-dichlorodifluoromethane, and 1,2-dichloro-1,1,2,2,-tetrafluoroethane, a hydrochlorofluorocarbon, such as 1,1,1,2-tetrafluoroethane and 1,1,1,2,3,3,3-heptafluoropropane, 1,1-difluoroethane, nitrogen, nitrous oxide, compressed air, carbon dioxide, dimethyl ether, isobutane, butane, propane, or mixtures thereof. In some embodiments, a mixture of propellants for dispersing composite particles comprises isobutane and dimethyl ether. The propellant(s) for the sprayable dispersion compositions is equal to or greater than 70 weight percent of the total weight of the dispersion. In some embodiments, the propellant has a concentration in a range from about 70 percent to about 99.9 weight percent, in a range from about 75 weight percent to about 95 weight percent, in a range from about 80 weight percent to about 95 weight percent, or in a range from about 85 to about 95 weight percent based on the total weight of the composite particles and the propellant of the sprayable dispersion composition.

In some embodiments, the sprayable dispersion compositions comprise other compounds or materials. Some of these compounds can include, for example, surfactants, stabilizers, additives and other known materials.

Sprayable dispersion compositions comprising composite particles and a propellant can be delivered from pressurized containers equipped with metering valves to a surface of a substrate. After application of the sprayable dispersion composition, the propellant volatizes from the surface resulting in a coating having lubricious properties. The volatility of the propellant removes the step of solvent removal from a coating applied to a surface.

Composite particles formed herein provide a composite material having lubricious properties and dispersibility in propellants. Composite particles formed by the method described herein can reduce manufacturing costs and increase efficiency when prepared in a single step procedure.

The disclosure will be further clarified by the following examples which are exemplary and not intended to limit the scope of the disclosure.

EXAMPLES

Unless otherwise noted, all parts, percentages, and ratios reported in the following examples are on a weight basis, and all reagents used in the examples were obtained, or are available, from the chemical suppliers described below, or can be synthesized by conventional techniques.

Coefficient of Friction

Coefficient of Friction Powder Test measurements (CFPT) were recorded on a Falex Multi-Specimen Test Machine, Computer Controlled Version (Serial No. 900631001816R; Falex Corporation, Sugar Grove, Ill.). A dry sample (e.g., composite particles, inorganic microparticles) (sample size: 50 ml) was placed in a specimen trough followed by assembly of the test machine adapter. Testing of the dry sample was conducted at a speed of 30 rpm (rounds per minute) at loads of 11 kg, 22 kg, 44 kg, and 66 kg, respectively. The dry sample testing was conducted at ambient conditions (20° C.) for 10 minutes or until friction measurement stabilized in the test equipment. Testing of the samples at 200° C. was conducted for 10 minutes under a load of 66 kg. The mean test radius was 1.26 cm.

Example 1

A mixture of Nalco 2326 colloidal silica (16.14 wt. % solids in water; 5 nm; Nalco, Bedford Park, Ill.) (5.02 grams), and an 80:20 (weight) wt./wt. % solvent blend of ethanol (EMD, Gibbstown, N.J.): methanol (VWR, West Chester, Pa.) (119 grams) was added to a 2 liter three-neck round bottom flask (Ace Glass, Vineland, N.J.) equipped with a mechanical stirrer (Sigma-Aldrich, St. Louis, Mo.) and mixed for 5 minutes at room temperature. Isooctyltrimethoxysilane (Gelest, Morrisville, Pa.) (0.33 grams) and an additional 580 grams of the ethanol: methanol solvent blend were added to the 2 liter round bottom flask and stirred for an additional 5 minutes at room temperature. The contents within the flask were heated in an oil bath set at 80° C. and stirred for 3 hours. Next, 200 grams of glass bubbles (S60HS; 3M Company, St. Paul, Minn.) were added to the mixture and stirred at 80° C. for an additional 16 hours. The mixture was transferred to crystallizing dishes (Sigma-Aldrich, St. Louis, Mo.) and dried in a convection oven at 130° C. for 2 hours. The dried mixture (10 grams) was added to a 250 ml Erlenmayer flask and stirred with an excess of toluene (EMD, Gibbstown, N.J.) (40 grams) for 5 hours at 20° C. and filtered. The filtrate (toluene) was transferred to a 500 ml round bottom flask, and concentrated with a rotary evaporator R-210 (Buchi Labortechnik AG; Switzerland) to recover unreacted 5 nm silica nanoparticles. Analysis of the filtrate by Transmission Electron Microscopy (TEM) (not shown) indicated an absence of non-aggregated 5 nm silica nanoparticles.

Example 2

A mixture of Nalco 2326 colloidal silica ((16.14 wt. % solids in water; 5 nm; Nalco, Bedford Park, Ill.) (10.06 grams), and an 80:20 (weight) wt./wt. % solvent blend of ethanol (EMD, Gibbstown, N.J.): methanol (VWR, West Chester, Pa.) (200 grams) were added to a 1 liter three-neck round bottom flask equipped with a mechanical stirrer and mixed for 5 minutes at room temperature. Isooctyltrimethoxysilane (Gelest, Morrisville, Pa.) (0.67 grams) and an additional 113 grams of an ethanol: methanol blend were added to the 1 liter round bottom flask and stirred for an additional 5 minutes at room temperature. The contents within the flask were heated in oil bath set at 80° C. and stirred for 2 hours. Next, 200 grams of ceramic microspheres (CM 111; 3M Company, Saint Paul, Minn.) and 190 grams of the ethanol: methanol solvent blend were added to the mixture within the round bottom flask, and stirred at 80° C. for an additional 16 hours. The mixture was transferred to crystallizing dishes and dried in a convection oven at 140° C. for 2 hours. The recovered particles were collected and ground with a mortar and pestle. Coefficient of friction test results for Example 2 are listed in Table 1.

Comparative Examples 1 (CE 1)

CM111 ceramic hollow microspheres (3M Company, Saint Paul, Minn.) were investigated for coefficient of friction measurements. Coefficient of friction test results for CE 1 are listed in Table 1.

Comparative Examples 2 (CE 2)

W610 ceramic solid microspheres (3M Company, St. Paul, Minn.) were investigated for coefficient of friction measurements. Coefficient of friction test results for CE 2 are listed in Table 1.

Comparative Examples 3-4 (CE 3-CE 4)

Boron Nitride CC6097 particles (Momentive Performance Materials Quartz Inc., Strongsville, Ohio) as CE 3, and Boron Nitride PTX25 particles (Momentive Performance Materials Quartz Inc, Strongsville, Ohio) as CE 4 were investigated for coefficient of friction measurements. Coefficient of friction test results for CE 3 and CE 4 are listed in Table 1.

TABLE 1

| Example | Materials | Inorganic Nanoparticle content (wt. %) | Coefficient of Friction (20° C.) | Coefficient of Friction (200° C.) |
|---|---|---|---|---|
| 2 | Composite Particles | 0.2 | 0.400 | 0.349 |
| CE 1 | Microparticles | N/A | 0.417 | 0.499 |
| CE 2 | Microparticles | N/A | 0.437 | 0.391 |
| CE 3 | Particles | N/A | 0.330 | 0.417 |
| CE 4 | Particles | N/A | 0.300 | 0.345 |

Example 2 showed a decrease in the coefficient of friction as the temperature increased from 20° C. (ambient conditions) to a temperature of 200° C.

Example 3

Composite particles of Example 2 (21.0 grams) were added to a four fluid ounce glass compatibility bottle and sealed with a 20 mm Emson valve (AptarGroup Incorporated, Crystal Lake, Ill.). Isobutane (31.2 grams; EMD, Gibbstown, N.J.) was charged to the compatibility bottle under pressure followed by the addition of 16.1 grams of dimethylether (EMD, Gibbstown, N.J.) to form a translucent stable sprayable dispersion composition. The sprayable dispersion composition was sprayed from the compatibility bottle as a fine powdery mist onto a surface of a film. After the propellant dissipated, a lubricious coating was formed on the surface of the film.

Comparative Example 5 (CE 5)

Ceramic microspheres, CM 111, were added to a 4 fluid ounce compatibility bottle having a 20 mm Emson valve with same propellants used for Example 3. The CM111 microspheres were poorly dispersed in the propellant, and settled to the bottom of the compatibility. CM111 microspheres in the propellant were difficult to redisperse. Spraying of CE 5 onto the surface of a film was attempted; the Emson valve was clogged during spraying.

Various modifications and alterations of this disclosure will be apparent to those skilled in the art without departing from the scope and spirit of this disclosure, and it should be understood that this disclosure is not limited to the illustrative elements set forth herein.

What is claimed is:

1. A composite particle comprising:

at least one inorganic microparticle;

at least one inorganic nanoparticle selected from the group consisting of zirconia, titania, silica, ceria, alumina, iron oxide, vanadia, zinc oxide, antimony oxide, tin oxide, nickel oxide, and combinations thereof; and a linking compound covalently bonding said nanoparticle to said microparticle, the linking compound of the formula:

$$Si(Z)_n(R)_m$$

wherein each Z is independently selected from the group consisting of —OR' and —X;

wherein R' is $C_1$-$C_6$ selected from linear, branched, and cyclic groups, or combinations thereof and optionally which may be substituted, and each X is a halide;

each R is $C_1$-$C_{18}$ selected from linear, branched, and cyclic groups, or combinations thereof, or which may be substituted; n is 0 or 1; and m is 1 or 2.

2. The composite particle of claim 1 wherein Z is a functional group that is capable of chemically reacting and attaching through M to the surface of each of the inorganic nanoparticle and the inorganic macroparticles.

3. The composite particle of claim 1 of the general formula:

$$(mp\text{-})Si(R)(\text{-}np),$$

where each R is $C_1$-$C_{18}$ selected from linear, branched, and cyclic groups, or combinations thereof;

(mp) represents a microparticle, and (np) represents a nanoparticle.

4. The composite particle of claim 1, wherein the at least one inorganic microparticle has a spherical, ellipsoidal, or cubic shape.

5. The composite particle of claim 1, wherein the at least one inorganic microparticle is selected from the group consisting of metals, metal oxides, or ceramics, and combinations thereof.

6. The composite particle of claim 5, wherein the metals, metal oxides, or ceramics are selected from the group consisting of zirconia, titania, silica, ceria, alumina, iron oxide, vanadia, zinc oxide, antimony oxide, tin oxide, nickel oxide, and combinations thereof.

7. The composite particle of claim 1, wherein the at least one inorganic microparticle has an average particle size in a range of greater than about 0.1 micrometer to about 500 micrometers.

8. The composite particle of claim 1, wherein the at least one inorganic nanoparticle has a shape selected from the group consisting of spherical, ellipsoidal, cubic, and combinations thereof.

9. The composite particle of claim 1, wherein the at least one inorganic nanoparticle has an average particle size in a range from about 1 nanometer to about 100 nanometers.

10. The composite particle of claim 1, wherein the linking compound is selected from the group consisting of an alkoxysilane, a halogenated silane, and combinations thereof.

11. The composite particle of claim 10, wherein the at least one linking compound comprises alkoxysilane, wherein R is C1-C10.

12. The composition of claim 1 wherein the weight ratio of inorganic nanoparticles to inorganic microparticles is in a range from 1:100,000 to about 1:20.

13. A method of forming a composite particle comprising:

providing a mixture of inorganic nanoparticles, a solvent, and at least one linking compound of the formula $$Si(Z)_n(R)_m$$

each Z is independently selected from the group consisting of —OR' and —X; wherein R' is $C_1$-$C_6$ selected from linear, branched, and cyclic groups, or combinations thereof or which may be substituted, and each X is a halide; each R is $C_1$-$C_{18}$ selected from linear, branched, and cyclic groups, or combinations thereof, or which may be substituted; n is 2 or 3; and m is 1 or 2;

agitating the mixture to provide nanoparticle precursors in which the linking compound is covalently bound to the nanoparticles;

adding inorganic microparticles to the mixture; and reacting the microparticles and the mixture to covalently bind the nanoparticle precursors to the inorganic microparticles through the linking compound.

14. The method of claim 13, wherein the weight ratio of inorganic nanoparticles to inorganic microparticles is in a range from about 1:100,000 to about 1:20.

15. The method of claim 13, wherein the mixture that is provided further comprises a second linking compound.

16. A grease composition comprising the composite particles of claim 1, a fluid lubricant, a thickener, the composition having lubricating properties.

17. A composition of claim 16, wherein the inorganic microparticle is selected from the group consisting of hollow inorganic microparticles, solid inorganic microparticles, and combinations thereof.

18. A composition comprising a propellant and the composite particles of claim 1 that are dispersed in the propellant, wherein the composition can be sprayed.

19. The composition of claim 18, wherein the multiplicity of composite particles has a concentration of at least 0.05 weight percent based on the total weight of the composition.

20. The composition of claim 18, wherein the propellant is selected from the group consisting of 1,1-difluoroethane, 1,1,1,2-tetrafluoroethane, carbon dioxide, nitrogen, nitrous oxide, air, isobutane, dimethyl ether, propane, and combinations thereof.

* * * * *